US011393442B2

(12) United States Patent
Giger et al.

(10) Patent No.: US 11,393,442 B2
(45) Date of Patent: Jul. 19, 2022

(54) ELECTRIC GUITAR WITH REPLACEABLE PICKUP, AND PICKUP ELEMENT FOR SAME

(71) Applicant: RELISH BROTHERS AG, Sempach-Station (CH)

(72) Inventors: Pirmin Giger, Neuenkirch (CH); Silvan Küng, Kehrsiten (CH)

( * ) Notice: Subject to any disclaimer, the term of this patent is extended or adjusted under 35 U.S.C. 154(b) by 0 days.

(21) Appl. No.: 16/961,608

(22) PCT Filed: Jan. 4, 2019

(86) PCT No.: PCT/EP2019/050176
§ 371 (c)(1),
(2) Date: Jul. 10, 2020

(87) PCT Pub. No.: WO2019/137857
PCT Pub. Date: Jul. 18, 2019

(65) Prior Publication Data

US 2021/0407487 A1 Dec. 30, 2021

(30) Foreign Application Priority Data

Jan. 10, 2018 (CH) ..... 00019/18

(51) Int. Cl.
*G10H 3/18* (2006.01)

(52) U.S. Cl.
CPC ..... *G10H 3/183* (2013.01); *G10H 3/181* (2013.01)

(58) Field of Classification Search
CPC ..... G10H 3/183; G10H 3/181
(Continued)

(56) References Cited

U.S. PATENT DOCUMENTS 4,364,295 A * 12/1982 Stich ..... G10H 3/181 984/368
4,425,831 A * 1/1984 Lipman ..... G10H 3/183 84/743

(Continued)

FOREIGN PATENT DOCUMENTS

DE 102010017697 A1 * 1/2012 ..... G10D 1/085
DE 102010017697 A1 1/2012

(Continued)

OTHER PUBLICATIONS

International Search Report and Written Opinion; PCT Application No. PCT/EP2019/050176; dated Apr. 25, 2019.

(Continued)

*Primary Examiner* — Christina M Schreiber
(74) *Attorney, Agent, or Firm* — Polsinelli PC

(57) ABSTRACT

The electric guitar contains at least one pickup in a recess on the guitar body. This pickup can be installed in a mounting frame and has electrical contact points which lead via a cable to the output port on the guitar body. The pickup has a fixing plate on its rear side, which is screwed onto the height adjuster of the pickup via a threaded bush at a variable distance from the base plate of the pickup. It contains spring-loaded pins which are electrically connected to the coils of the pickup. The fixing plate can be inserted without tools from the rear of the guitar body into a recess in the pickup frame and removed again from the pickup frame without tools. When the pickup is inserted, the pins on the fixing plate are connected to the electrical contact points on the mounting frame and the fixing plate is held in place on the mounting frame by means of permanent magnets.

10 Claims, 12 Drawing Sheets

(58) Field of Classification Search
USPC ..... 84/726
See application file for complete search history.

(56) References Cited

U.S. PATENT DOCUMENTS

| | | | | | |
|---|---|---|---|---|---|
| 4,854,210 | A * | 8/1989 | Palazzolo | G10H 3/181 | 84/743 |
| 5,029,511 | A * | 7/1991 | Rosendahl | G10H 3/181 | 84/723 |
| 5,252,777 | A * | 10/1993 | Allen | G10H 3/182 | 84/743 |
| 5,747,711 | A * | 5/1998 | Cavaness | G10D 1/085 | 84/293 |
| 6,111,184 | A * | 8/2000 | Cloud | G10H 3/185 | 84/723 |
| 6,194,644 | B1 * | 2/2001 | Hendrickson | G10D 1/085 | 84/723 |
| 6,253,654 | B1 * | 7/2001 | Mercurio | G10D 1/085 | 84/293 |
| 8,178,774 | B2 * | 5/2012 | Salehi | G10H 3/181 | 84/723 |
| 8,283,552 | B2 * | 10/2012 | van Ekstrom | G10H 3/183 | 84/743 |
| 8,455,750 | B1 * | 6/2013 | Severson | G10H 1/32 | 84/743 |
| 9,601,100 | B1 * | 3/2017 | Dixon | G10H 3/182 | |
| 9,773,488 | B2 * | 9/2017 | Wolf | G10H 3/183 | |
| 10,002,599 | B1 * | 6/2018 | Wolf | G10H 3/183 | |
| 10,311,850 | B2 * | 6/2019 | Canivell Grifols | G10D 1/085 | |
| 10,311,851 | B1 * | 6/2019 | Stadnyk | G10H 3/183 | |
| 10,540,946 | B2 * | 1/2020 | Reddick | G10D 3/02 | |
| 10,861,430 | B1 * | 12/2020 | Stanton | G10H 1/342 | |
| 11,024,269 | B2 * | 6/2021 | Reddick | G10D 1/085 | |
| 11,074,898 | B1 * | 7/2021 | Boxberger | G10H 3/181 | |
| 11,145,280 | B2 * | 10/2021 | Shibuya | G10D 3/22 | |
| 2001/0022129 | A1 * | 9/2001 | Damm | G10H 3/181 | 84/291 |
| 2013/0276621 | A1 * | 10/2013 | Bekerman | G10H 3/181 | 84/723 |
| 2015/0294659 | A1 * | 10/2015 | Chapman | G10D 1/085 | 84/743 |
| 2017/0025102 | A1 * | 1/2017 | Brown, Jr. | G10D 3/12 | |
| 2017/0053631 | A1 * | 2/2017 | Strassell | G10H 3/181 | |
| 2021/0035544 | A1 * | 2/2021 | Skillings | G10H 3/182 | |
| 2021/0407487 | A1 * | 12/2021 | Giger | G10H 3/183 | |

FOREIGN PATENT DOCUMENTS

| | | | | |
|---|---|---|---|---|
| EP | 3352165 | A1 * | 7/2018 | G10D 1/085 |
| EP | 3352165 | A1 | 7/2018 | |
| ES | 2625687 | A1 | 7/2017 | |
| ES | 2625687 | B1 * | 1/2018 | |
| WO | 9939330 | | 8/1999 | |
| WO | WO-9939330 | A1 * | 8/1999 | G10H 3/182 |
| WO | WO-2019137857 | A1 * | 7/2019 | G10H 1/32 |

OTHER PUBLICATIONS

English Translation of International Search Report.
English abstract of DE102010017697; retrieved from www.epacenet.com on Jul. 9, 2020.
English abstract of ES2625687; retrieved from www.epacenet.com on Jul. 9, 2020.

* cited by examiner

Fig. 1
PriorArt
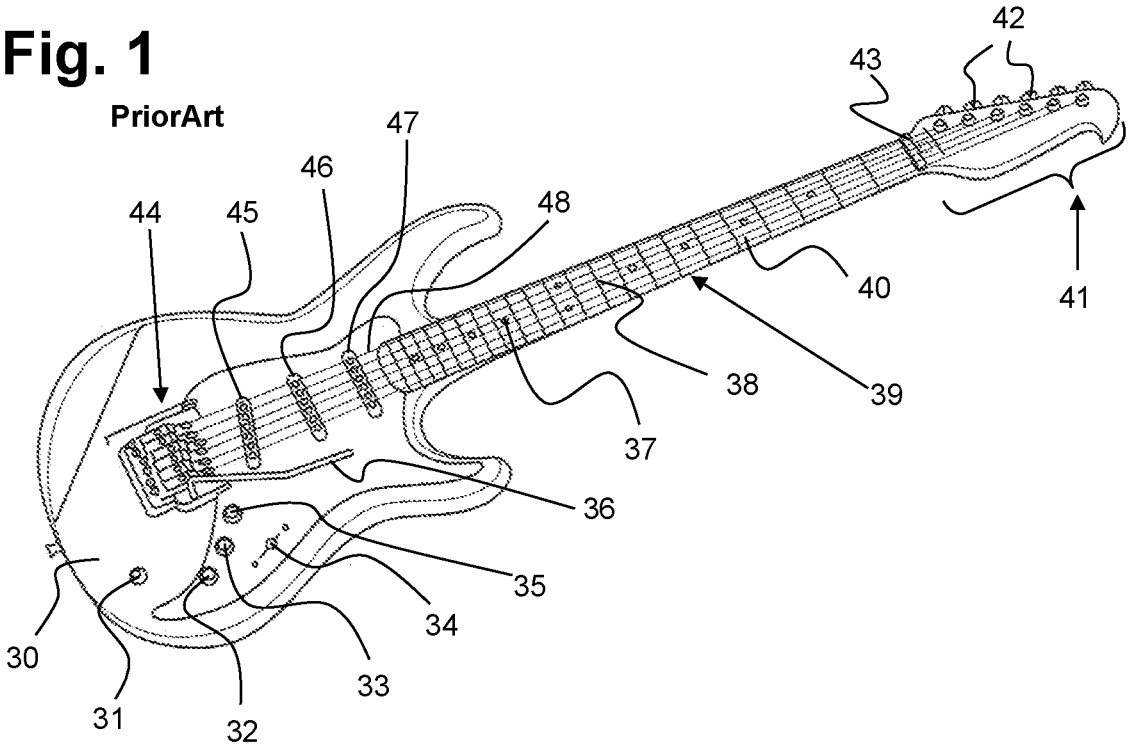

ELECTRIC GUITAR WITH REPLACEABLE PICKUP, AND PICKUP ELEMENT FOR SAME

CROSS-REFERENCE TO RELATED APPLICATIONS

This application is a national stage entry of internation application number PCT/EP2019/050176 filed Jan. 4, 2019, which claims the benefit of Switzerland Application No. 00019/18, filed Jan. 10, 2018, each of said applications are expressly incorporated herein by reference in their entirety.

FIELD OF THE INVENTION

Electric guitars can produce a wide variety of sounds, which are produced by the vibration of strings, which are then electrically amplified. A traditional electric guitar is equipped with one or two so-called pickups, which are placed on the guitar body just below the strings, between the neck of the guitar neck, i.e. between the back end of the fingerboard and the bridge. Each pickup of a so-called pickup consists of an electric coil of several thousand turns of varnished copper wire around a magnetic core, and the two ends of the coil are electrically connected to an amplifier system via an insulated cable. The vibration of the string near one end of the coil induces electric currents in the coil due to the magnetic flux altered by the vibration of the string, which are used to produce sounds electrically by means of the amplification system, which then sends the amplified electric signals to a loudspeaker. Although the change in magnetic flux due to the vibrating string is very small, it is sufficient to generate a voltage of normally a few tens to a few hundred millivolts with a correspondingly high number of turns. The change in field strength and thus the induced voltage is greatest when the string swings back and forth to the pole instead of swinging sideways back and forth. The ferromagnetic strings must not be attracted by the magnet to such an extent that their vibration is significantly affected, otherwise they will sound impure. Consequently, with particularly strong magnets, the whole pickup must be positioned further away from the strings than with relatively weak magnets, which results in a reduction in output voltage compared to an equal distance, so that overall there is no higher output voltage. Extra-strong magnets therefore have no advantages. And no magnet can affect the sound because it only generates a magnetic field. It makes no difference whether the magnetic field is generated by a relatively expensive neodymium magnet, a cheap ferrite magnet or even an electromagnet, although the latter are not common in guitar pickups. There is only one theoretical influencing factor, namely the eddy currents that are generated in the magnet when the magnetic flux changes due to the string vibration. Eddy currents increase the damping of the sound-forming resonance peak. But here it is precisely the ferrite magnets, which are hardly electrically conductive, often referred to as ceramic magnets to create the feeling of higher valency, that are superior to expensive but electrically conductive alternatives such as AlNiCo magnets, because with them the eddy currents and thus the damping are negligible. In a pickup, however, the magnet is normally only responsible for a very small part of the damping. The whole discussion about the magnet material is therefore not justified. In particular, no magnet can sound "warm" or even aggressive, i.e. a magnet has no frequency response. The reasons for the "warm sound" of a pickup are always quite different. The sound depends very much on the nature of the coils.

BACKGROUND

The major disadvantage of such a pickup is its susceptibility to low-frequency magnetic fields, such as those generated by power transformers and ballasts of fluorescent lamps. When magnetic fields change, a voltage is induced in the coil. Therefore, a voltage is also induced in the pickup by these interference fields. This can easily be avoided by using two pickups instead of one and connecting them in series, i.e. one after the other, with reversed polarity. This has the effect that an external magnetic field induces a voltage in both coils, but these voltages cancel each other out due to the reversed polarity of the coils, so that no voltage is delivered at the output. The same happens with the useful signal, which is of course undesirable. But here you can easily remedy this by reversing the polarity of the magnets in a coil. This way, the coil produces a useful signal with the opposite polarity, but the opposite polarity of the coil means that the signal is the right way round again. Thus, a voltage twice as high as with only one coil appears at the output. Such pickups are called humbuckers or humbucking pickups, which are usually enclosed in a metal housing. They are used for example in the Gibson Les Paul and produce the Gibson tonality with two pickups with double coils.

In contrast, three pickups, each equipped with individual coils, produce what is known as Fender tonality, and these individual coil pickups are called single coil pickups. Guitars with the so-called humbucker pickups are mainly used for hard rock music, i.e. for a hard and full sound, while those with Fender tonality or also called Fender Stratocasters are used for country music and produce a somewhat nasal sound.

Musicians have always wanted to be able to produce different sounds on their electric guitars, preferably sounds that go beyond the fullness of sound offered by a single guitar. When a guitar is played with single coils, for example, you want to be able to switch to a humbucker pickup and vice versa. Guitars that have two pickups arranged one after the other under their strings can be activated, for example, by pressing a switch with three positions as desired. In one position of the switch the front, the so-called neck pickup is active, in a middle position both pickups are active and in a third position only the rear, so-called bridge pickup is active.

DESCRIPTION OF RELATED ART

The US 2015/0294659 A1 proposes another solution how to change from one pickup to another by placing several pickups on a rotating disc, which is mounted on the guitar body, where the desired pickup can be turned under the strings and the disc locks in this position. While this system allows the tonality to be changed quickly while playing, the tonality is limited to a limited number of pickups arranged on the turntable.

An installed pickup, whether mounted on the guitar body or on such a turntable, is always hard-wired and screwed to the base and can only be detached and replaced by another pickup with considerable effort.

SUMMARY

The task of the present invention is it—in view of this background—to create a guitar with pickups that are toolless, i.e. that can be exchanged purely by hand, and to create the necessary pickup elements so that these pickups can be used in the guitar in a large number and variety depending on the requirements, easily and very quickly, i.e. within 3 to 5 seconds. In a special design of the guitar, at least two pickups should be able to be continuously switched on and off.

This task is solved by an electric guitar with at least one pickup in a continuous recess on the guitar body, characterized in that the pickup can be inserted into this recess from the back of the guitar body without tools within a maximum of 5 seconds and in doing so closes electrical contacts between its coils and connections in the recess in its fit, which lead via a cable to the output port on the guitar body, and that the pickup is held in its fit so that it can be released by hand without tools. Furthermore, the task is solved by a pickup element for an electric guitar, which is characterized by the fact that it has a fixing plate with a threaded bush for the height adjuster of the pickup and a locating hole for the guide pin on the base plate of the pickup, wherein the fixing plate can be fixed to an associated mounting frame which is intended for installation in a continuous pickup recess on a guitar body, and which forms a fitting seat for this fixing plate, can be inserted by hand without tools and can be released again from this mounting frame. For the infinitely variable switching on and off of the pickups, a touch screen is arranged in a special version of the guitar on the outside of the guitar body, and an electronic circuit is provided in or on the guitar body, so that by sliding a finger on the touch screen the individual pickups can be switched on or off infinitely more or less.

BRIEF DESCRIPTION OF THE DRAWINGS

The drawings show examples of such a guitar with interchangeable pickups as well as the pickup element used for it. The following description describes it in more detail and explains how to insert and remove the pickup element, how it works and how to switch the pickups on and off continuously.

It shows:

FIG. 1: A conventional guitar with three pickups and a switch lever;

DETAILED DESCRIPTION

Figure 2:
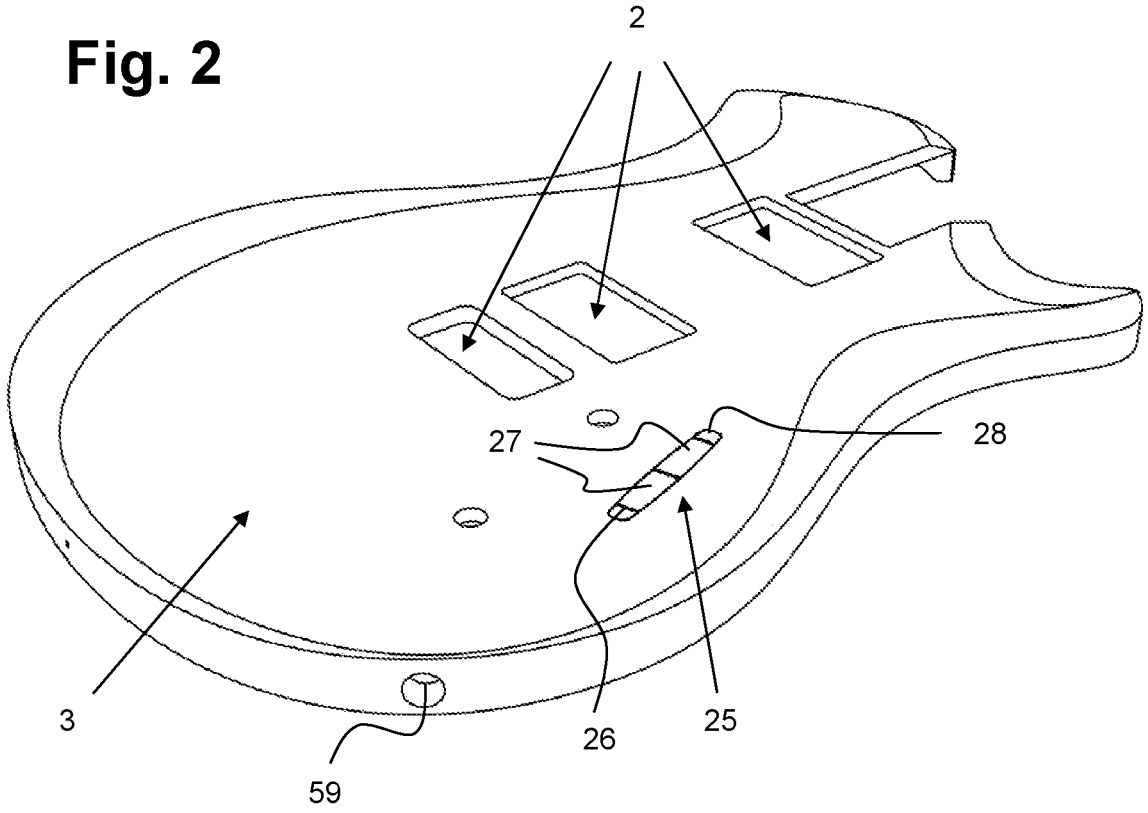
FIG. 2: The empty guitar body of an electric guitar, with recesses for three quickly replaceable pickups.

First of all, FIG. 1 shows a conventional electric guitar and its components. The guitar body consists of a massive body 30, mostly made of wood. It has a connection socket 31 for the output of electrical signals to an amplifier system. In the lower part of the outside of the guitar body there are two tone controls 32, 33 and a volume control 35, all of which are designed as rotary knobs. A pickup selector 34 is realized here by a switch lever with three positions. Further you can see a vibration lever 36. The plate, which covers the area below the strings on the guitar body, acts as an impact protection. On the neck 39 there is a fretboard 40 and frets 38 and orientation inlays 37 on the fretboard. At the end of the neck 39 there is the collar 41 with the nut 43 at the transition from the neck 39 to the collar 41 and on the collar the tuning pegs 42 are arranged. On the back of the guitar body the string suspension 44 is located and below the strings 48 the pickups are located, here a treble pickup 45, a mid-position pickup 46 and a bass pickup 47. These pickups can only be replaced with a relatively large effort and with the help of tools. Often they are replaced from the front side visible here, for which purpose the strings 48 have to be loosened, which of course requires a renewed tensioning and tuning of the strings 48 afterwards.

The present invention creates a guitar on which the pickups can be changed in a few seconds and without tools. For this purpose, the guitar body 3 is provided with at least one continuous recess 2 as shown in FIG. 2. In the example shown, the guitar body has three such continuous recesses 2. In the rear area of the guitar body 3 you can see here a touch screen 25, which is sensitive and effects different circuits of the electronic circuitry housed in the guitar body in different areas. If you press the touchscreen 25 for 2-3 seconds in the very rear end area 26, the bridge pickup is switched on, i.e. pickup 45 for the high notes first of the bridge or string suspension. In the other, front end area of the touchscreen 25, touching the end area 28 there for 2-3 seconds switches on the neck pickup, i.e. the pickup for the bass notes. Between these two end areas 26, 28 on the touch screen 25, namely in area 27, the pickups can be switched on and off continuously. So you can move your finger from back to front over the touchscreen 25 and then the high tones are continuously getting weaker and weaker and the low tones more and more strongly picked up by the strings. Conversely, if you move your finger from the front to the back, the low tones slowly become weaker and weaker and the high tones stronger and stronger. Another function is realized as follows: If you press with one finger, preferably the index finger berry, on the front area of the touch screen 25 and with another finger, preferably the middle finger berry, on the middle area of the screen, the neck pickup is switched on immediately and the bridge pickup is switched off immediately at the same time. If you press the touchscreen 25 again in this way, both pickups are activated again, i.e. the bridge pickup is switched on again. If you press with one finger, preferably with the index finger berry, in the middle area of the touch screen and with another finger, preferably with the middle finger berry, on the back of the screen, the neck pickup is immediately switched off and the bridge pickup is switched on at the same time. If you press the touch screen again in this constellation, the neck pickup is switched on again. At the edge of the guitar body 3, at the lowest point when the guitar is hanging on the shoulders of a player in playing position, you can still see hole 59 for the guitars output port.

Figure 3:
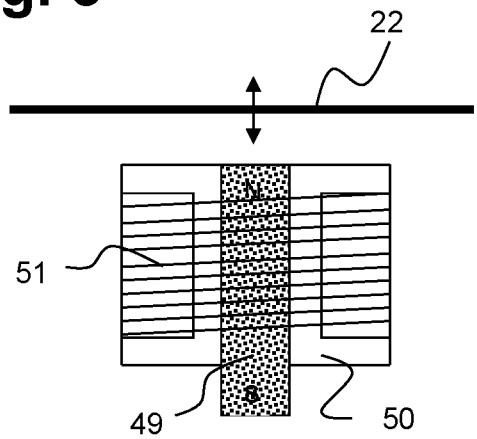
FIG. 3: A rod magnet arrangement for the pickup.
Figure 4:
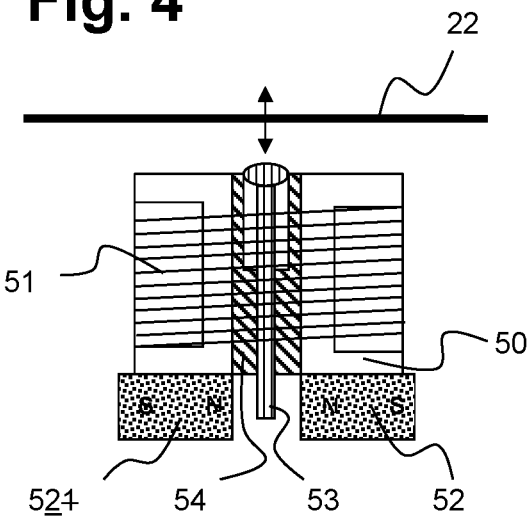
FIG. 4: A bar magnet assembly for the pickup.

FIG. 3 shows a single pickup of a pickup. A bar magnet 49 is wound with copper wire 51 on a coil former 50. Instead of using six individual pickups with one coil each, one often takes six bar magnets 49 and winds a single coil around them, using a cardboard or plastic holder to prevent the magnets and coil from moving against each other, in order to save material and also to keep the angular space compact. As an alternative to single bar magnets, one or two bar magnets 52 as shown in FIG. 4 can be used, and the magnetic field can be guided through the coil with ferromagnetic bars or better adjusting screws 53, which are provided with a socket 54 for this purpose. The volume of the individual strings 22 can be adjusted by positioning the pickup of the pickup more or less close to the string 22. This is less convenient for pickups with bar magnets 49 and often only possible with a small hammer, which can be used to move the bar magnets 49 further away from the strings 22 by gently tapping them. If the rod magnet 49 has slipped too far down, you often have to remove the pickup to get to the other side.

Figure 5:
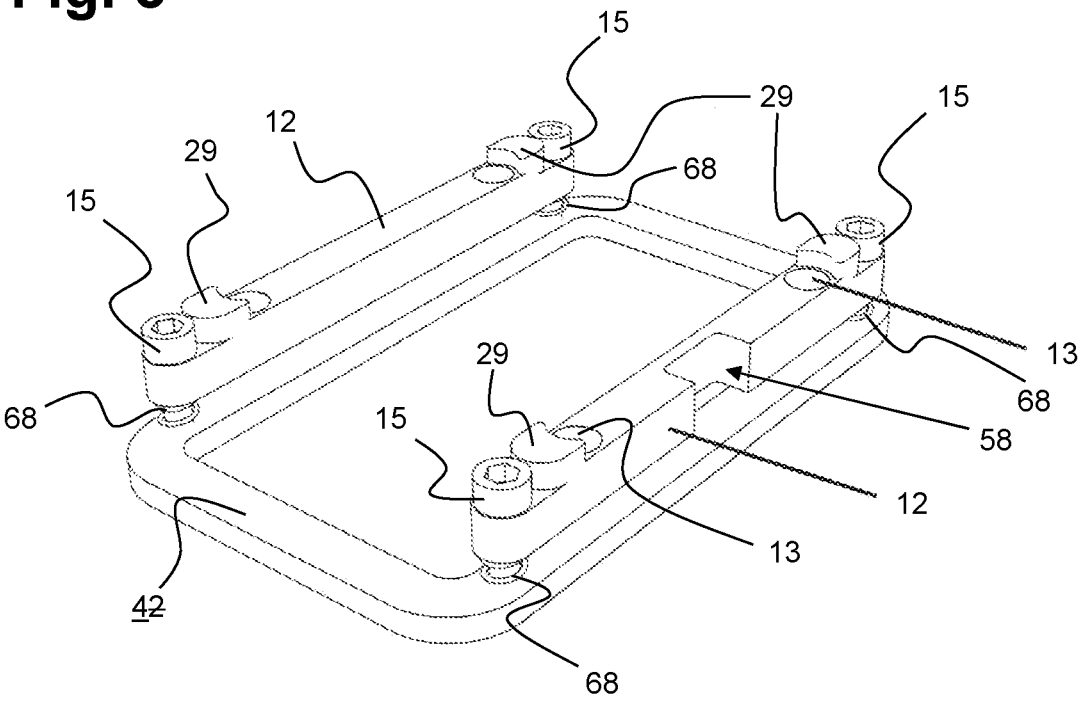
FIG. 5: The mounting frame for the interchangeable pickup.

In order that a pickup can be inserted into a precise fit in the recess 2 provided in the guitar body 3 as shown in FIG. 2 and without the need for tools and so that it can be quickly exchanged, a mounting frame 4 as shown in FIG. 5 is preferably inserted into recess 2 of the guitar body 3. On two opposite sides of the mounting frame 4, side holders 12 are screwed on with Allen screws 15. Pressure springs 68 are fitted around the screws 15 under the side holders 12. The side holders 12 are screwed onto the mounting frame 4 by compressing these compression springs 68. These side holders 12 with their cams 29 at the ends form an exact fit for a fixing plate 14 on the pickup to be used. Two permanent magnets 13 are inserted into the top of each of these side holders 12, which hold the magnetic fixing plate 14 in the inserted condition in a snug fit. One side holder 12 has a recess 58, into which an element with the electrical contact points is inserted, whereby these contact points form a dent at each end, into which spring-loaded pins of the electrical outlets of the pickup to be inserted fit. By adjusting the screws 15 and more or less compressing the built-in compression springs 68, the position of the side holders 12 can be changed and thus also of the pickup to be placed on them, as it soon becomes clear. In one variant, this frame can be made as a single injection-moulded part of plastic, i.e. the pick-up frame 2 and the side holders 12 which sit directly on it in one piece, in which case the compression springs 68 for changing the position of the side holders 12 are no longer needed.

Figure 6:
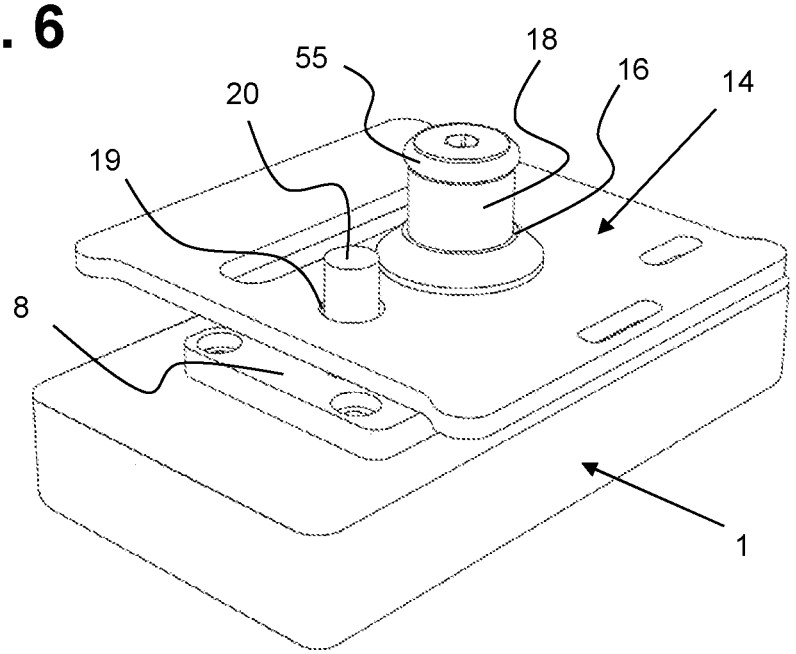
FIG. 6: The fixing plate with the base plate underneath on the pickup and pickup.

FIG. 6 shows the fixing plate 14 and below it the pickup 1 with its base plate 8 in a tilted position. The height adjuster 18 consists of a threaded brass rod, which is mounted in the base plate 8 with its thread 17 and on which a rubber wheel 55 is screwed at the end, which can be easily turned with two fingers. The brass thread 17 of the height adjuster 18 is located in a threaded bush 16 in the fixing plate 14. The fixing plate 14 also has a locating hole 19 for a guide pin 20 projecting vertically from the base plate 8, over which the fixing plate 14 with its locating hole 19 is slipped. By turning the rubber wheel 55, the distance between the fixing plate 14 and the base plate 8 can be finely adjusted.

Figure 7:
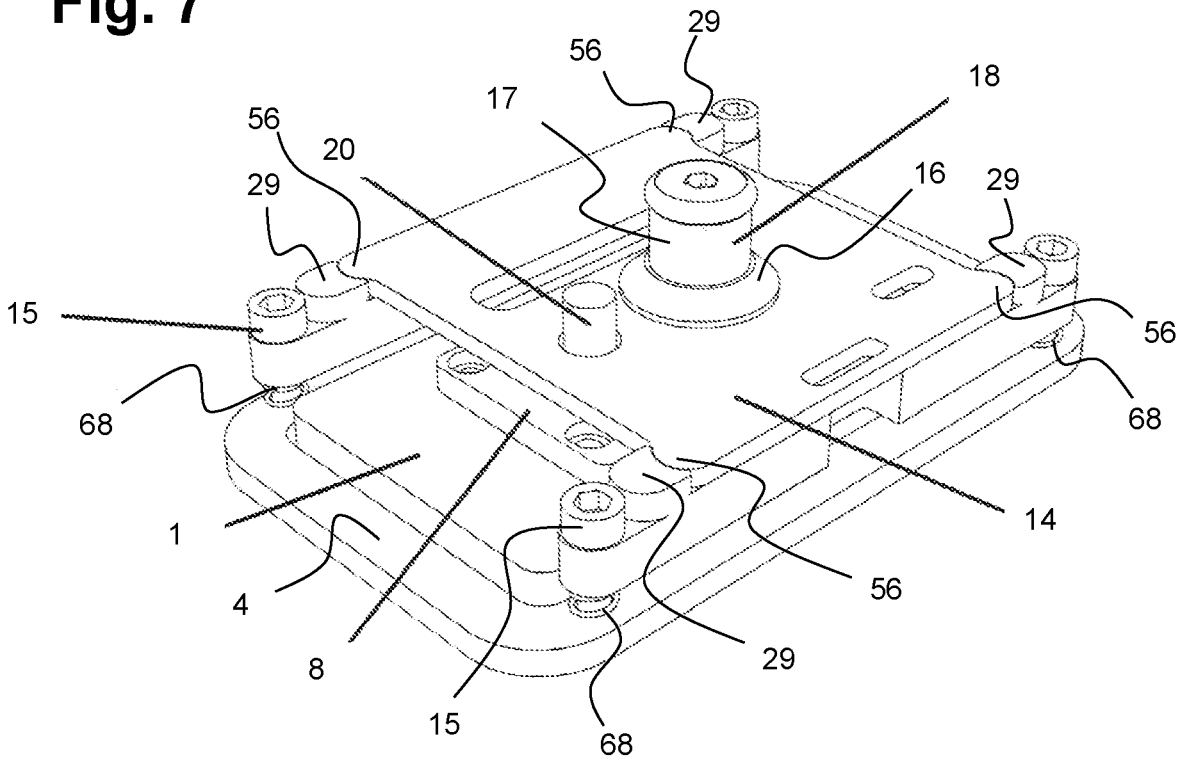
FIG. 7: The pickup inserted into the side holders on the pick-up frame.

FIG. 7 shows how this pickup element with its fixing plate 14 is inserted into the fitting seat on the mounting frame 4. The fixing plate 14 is shaped at its four corners into bulges 56, which fit exactly into the cams 29 on the side holders 12 on the mounting frame 2. The four permanent magnets 13 in the side holders 12 strongly attract the ferromagnetic fixing plate 14 and thus hold it securely in its fit. By adjusting the screws 58, the inserted pickup can be tilted more or less in all directions. For example, the distance of its pickups to the strings for the low notes and the strings for the high notes can be adjusted differently. If the frame is made of plastic, the fixing plate 14 can also be an injection-moulded plastic part that fits exactly to the frame, which then fits precisely into the frame between the end cams 29 and is held in this fit by permanent magnets 13.

Figure 8:
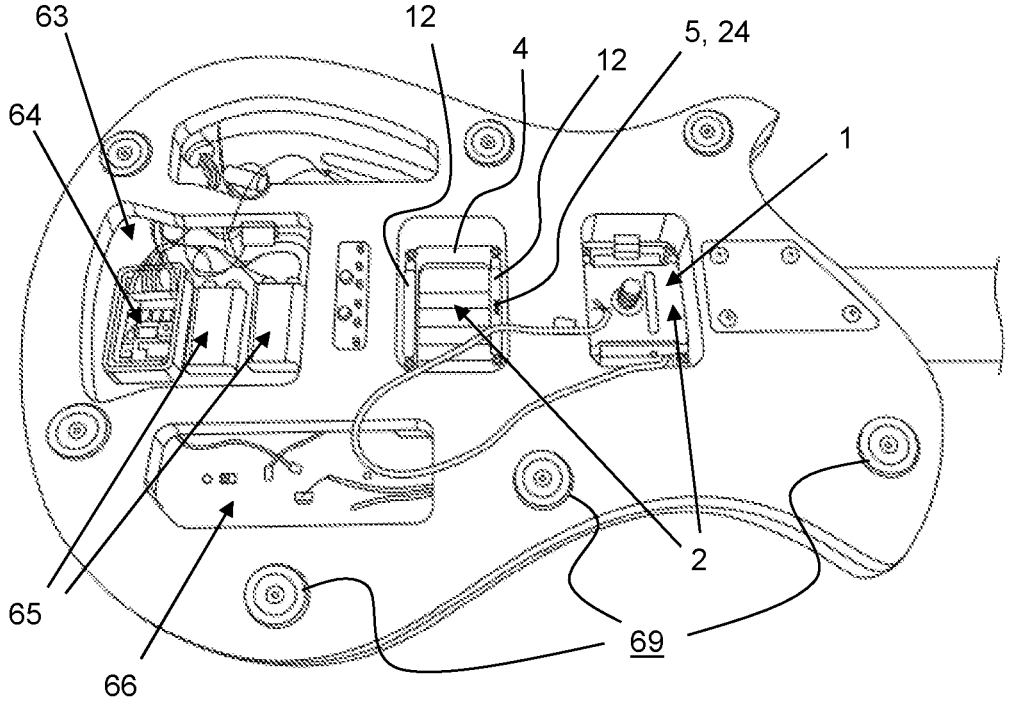
FIG. 8: A guitar body with two recesses for the pickups and other recesses.

FIG. 8 shows a guitar body 3 with two recesses 2 for the pickups 1 and a further recess 63 to accommodate the electronic circuit 64 and the batteries that supply it with power 65. A laterally offset recess 66 serves to accommodate the operating display, a touch screen to be inserted 25. The screwed-on rubber wheels 69 visible along the edge of the guitar body serve as a holder for a cover to be placed on it. In the front recess 2 you can see the inserted neck pickup, and in the rear recess 2 you can see the built-in mounting frame 4 with its side holders 12. For the installation of the mounting frame 4, a step is formed on the inner wall of the recesses, so that a circumferential bearing surface is formed for the mounting frame 4, onto which the mounting frame 4 can be glued, for example. In one of the side holders you can see the electrical contact points 5, each of which forms a dent 24, and which contact points 5 are led via a cable to the out-put port on the guitar body 3.

Figure 9:
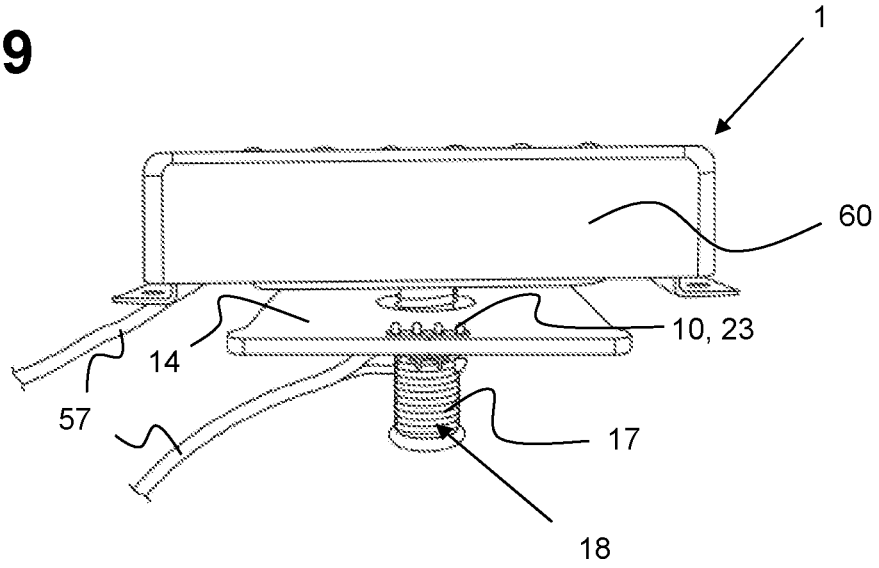
FIG. 9: The pickup with fixing plate and height adjuster thread in a side view.

FIG. 9 shows the pickup 1 screwed onto its height adjuster 18 by means of the thread 17 of its threaded bush 16 with the fixing plate 14. The coils, coil bobbins and pickups of pickup 1 are housed and wired in a chrome-plated sheet metal housing 60. At the fixing plate 14, directed towards the pickup 1, spring-loaded pins 23 protruding from the fixing plate 14 are arranged as electrical outlets 10 from the pickup 1. These pins 23 fit into the dents 24 at the contact points 5 of the side holders 12, for safe closing of electrical connections. The pins 23 are wired via cable 57 to the coils of the corresponding pickups of pickup 1.

Figure 10:
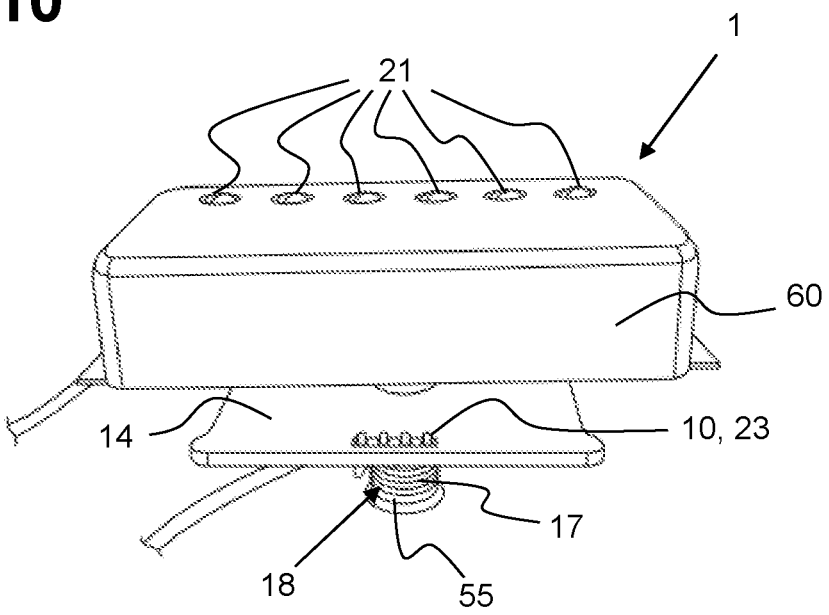
FIG. 10: The pickup with fixing plate and height adjustment thread in a perspective view.
Figure 11:
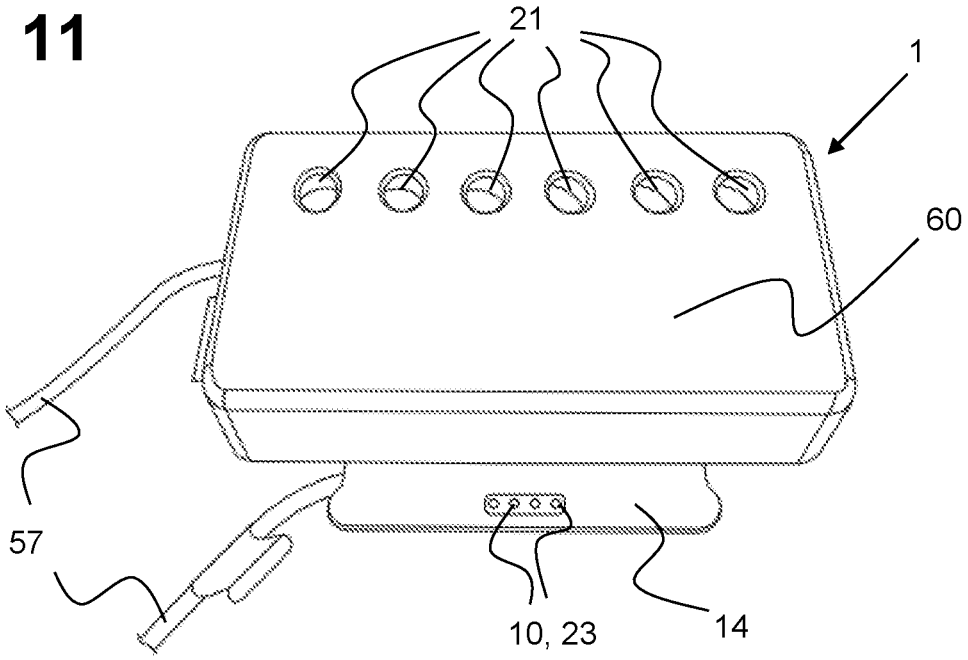
FIG. 11: The pickup with fixing plate and contact heads, seen from above.
Figure 12:
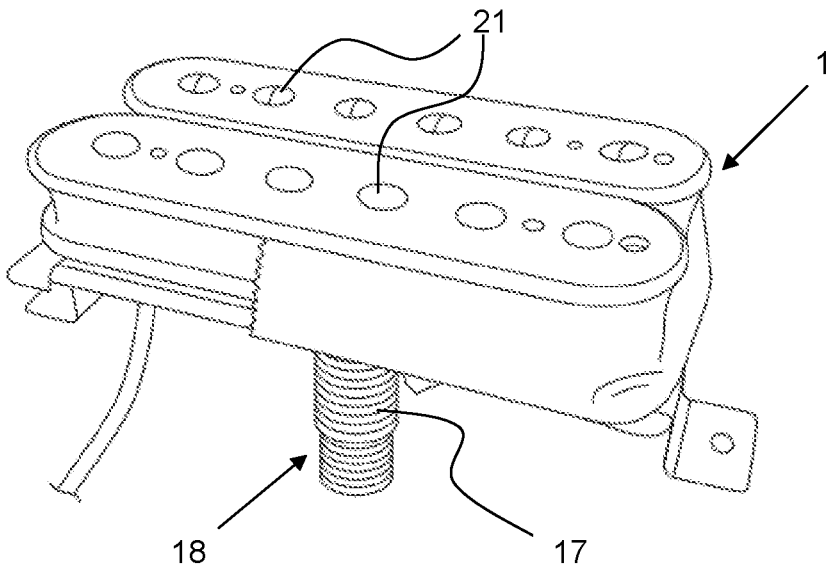
FIG. 12: An alternative pickup with two rows of pickups.

In FIG. 10, Pickup 1 is shown with its chrome-plated sheet metal housing 60 with the fixing plate 14, which can be adjusted in distance from its base plate, further inclined towards the viewer. In this illustration you can see the six pickups 21 on the upper side of pickup 1 and in FIG. 11 the pickup 1 and its housing 60 is shown seen from above. Therefore you can see here the six pickups 21 and below the pickup 1 the fixing plate 14 with its four contact pins 23 for the electrical outputs 10 of the pickup 1 or its pickup coils. Finally, FIG. 12 shows an alternative pickup 1 with two rows of pickups 21.

Figure 13:
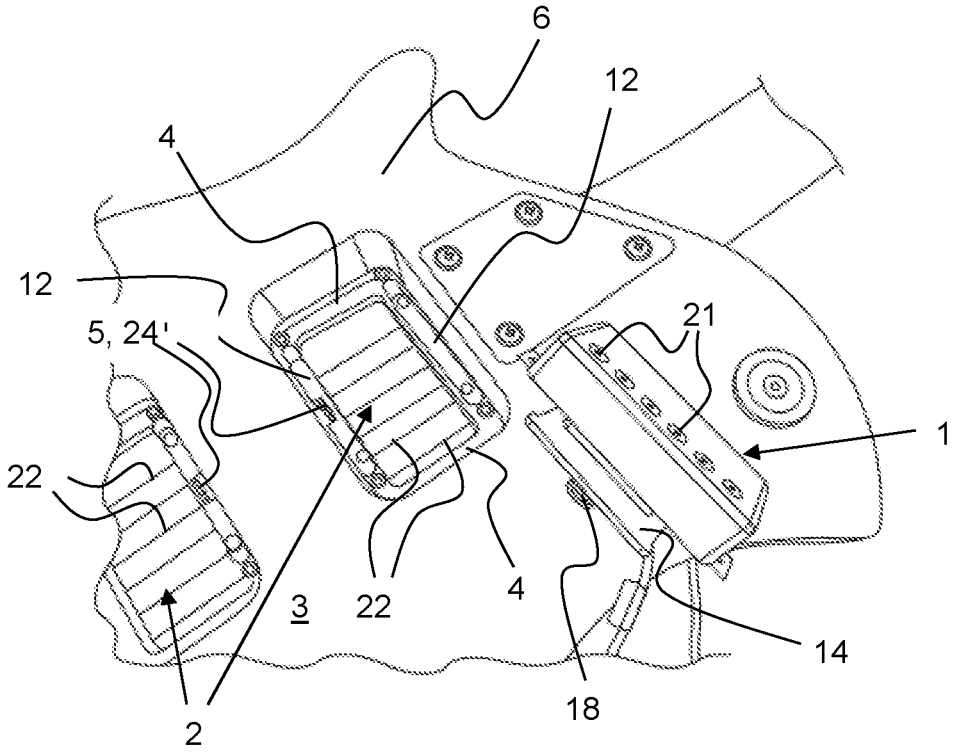
FIG. 13: A section of the guitar body with two recesses and next to the front recess the pickup to be inserted with its pickups visible on top.

FIG. 13 shows a section of the rear side 6 of the guitar body 3 with two recesses 2 and next to the front recess 2 the pickup 1 to be inserted with its pickups 21 on its upper side and its fixing plate 14 on its lower side, which is screwed onto its height adjuster 18. The pick-up element which can be inserted without tools is here on one side, i.e. it is shown in perspective diagonally seen from the side, whereby the upper side of pick-up 1 with its pickups 21 is also visible. In the recesses 2 you can see the pickup frames 4 with their side holders 12 and the contact points 5 with the dents they form 24. At the very bottom, below the recesses 2 and the guitar body 3, the strings 22 are running.

Figure 14:
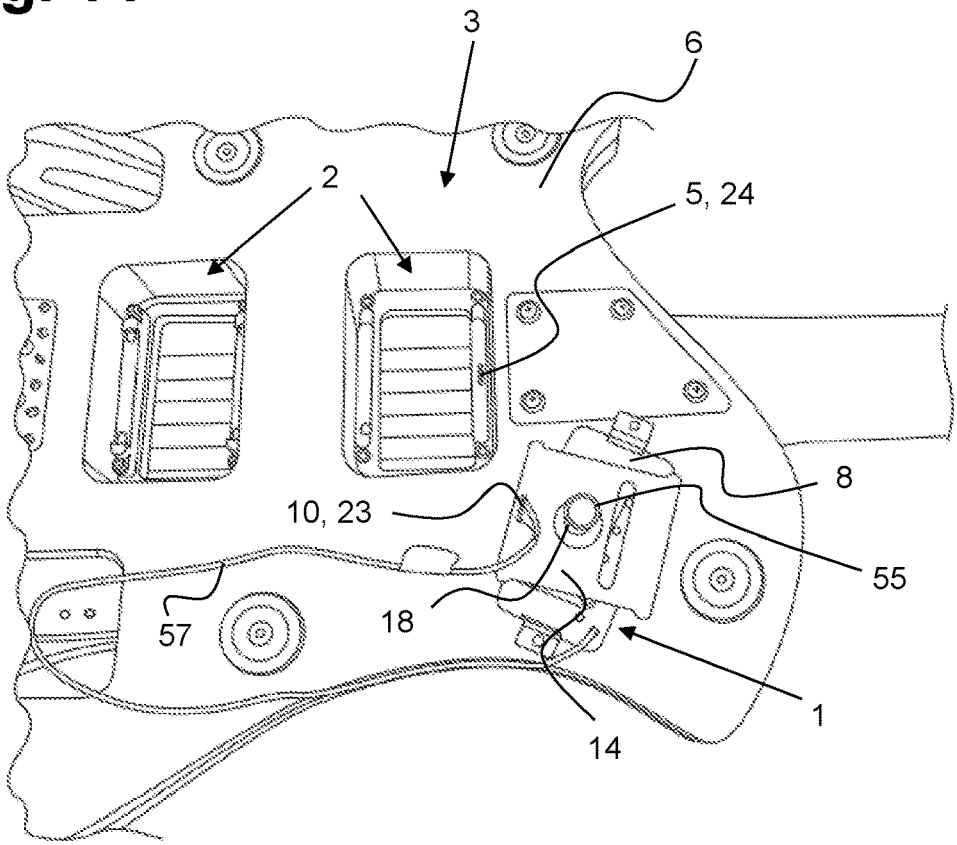
FIG. 14: A cutout of the guitar body with two recesses and next to the front recess the pickup element to be inserted with the pickups on the lower side, ready for insertion.

FIG. 14 shows the cut-out of the back 6 of the guitar body 3 with the two recesses 2 and next to the front recess the pickup 1 to be inserted in its fallen position with the fixing plate 14 screwed onto its height adjuster 18 and the rubber wheel 55 at the end of the height adjuster 18 for turning its brass thread and thus adjusting the distance of the fixing plate 14 to the base plate 8 of the pickup 1. The cable 57 connects the coil hangers with the spring-loaded pins 23 on the fixing plate 14, which in the view shown project downwards from the fixing plate 14.

Figure 15:
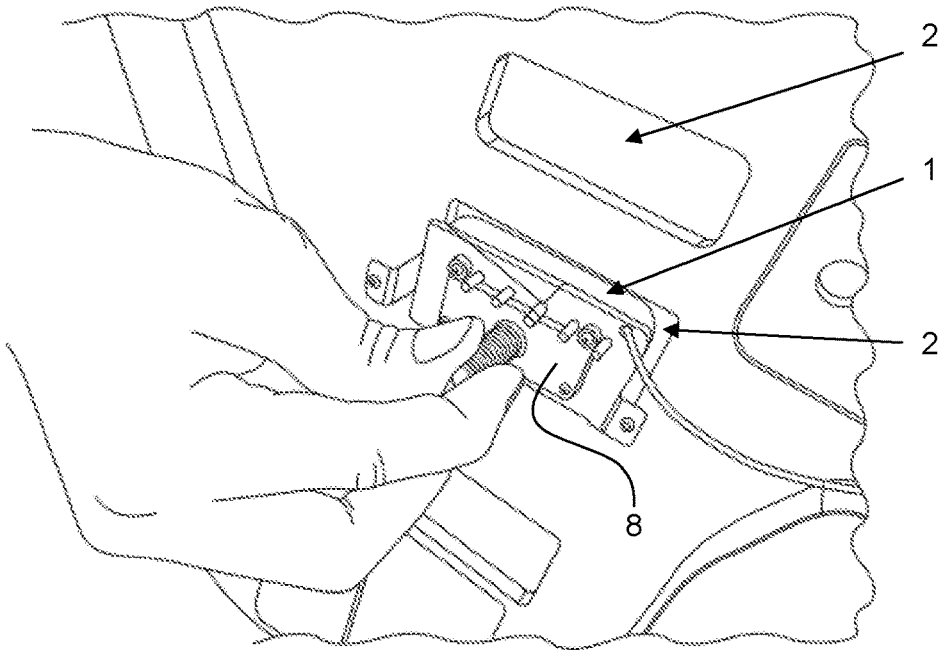
FIG. 15: A pickup element as it is inserted from the back of the guitar body.

FIG. 15 shows how the pickup 1 is inserted from the back 6 of the guitar body 3 into the recess 2 on the guitar body 3, although here the mounting frame 4 and the fixing plate 14 are still missing. Take hold of the pickup 1 with thumb and index finger at its height adjuster 18 and insert it into the recess 2. If it is equipped with the fixing plate 14 and the recess is fitted with the mounting frame 4, the fixing plate 14 is positioned exactly on the fitting seat on the mounting frame 4 and held firmly in the fitting seat by the permanent magnets 13 on the side holders 12. The spring-loaded pins 23 on the fixing plate 14 are automatically pressed onto the dents 24 of the electrical contacts 5 on the side holder 12 and thus a secure electrical connection between the coils of the pickup and the output port 7 of the electric guitar is established.

Figure 16:
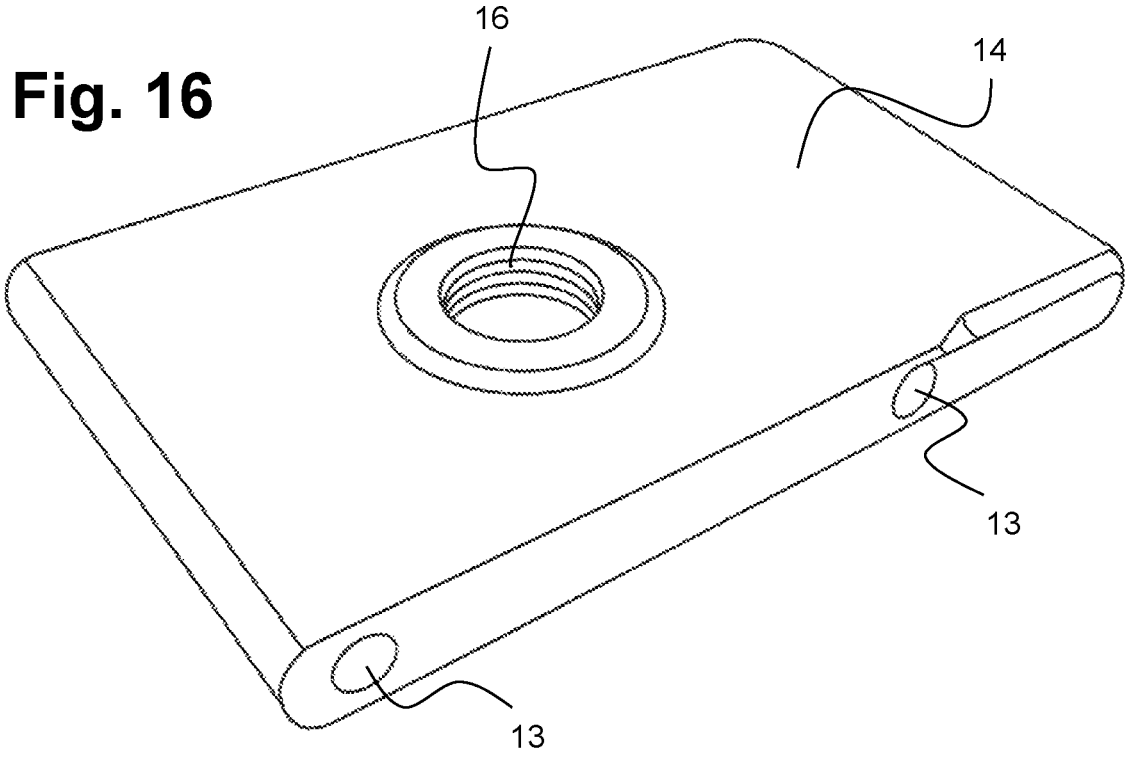
FIG. 16: An alternative version of the fixing plate with central threaded hole.
Figure 17:
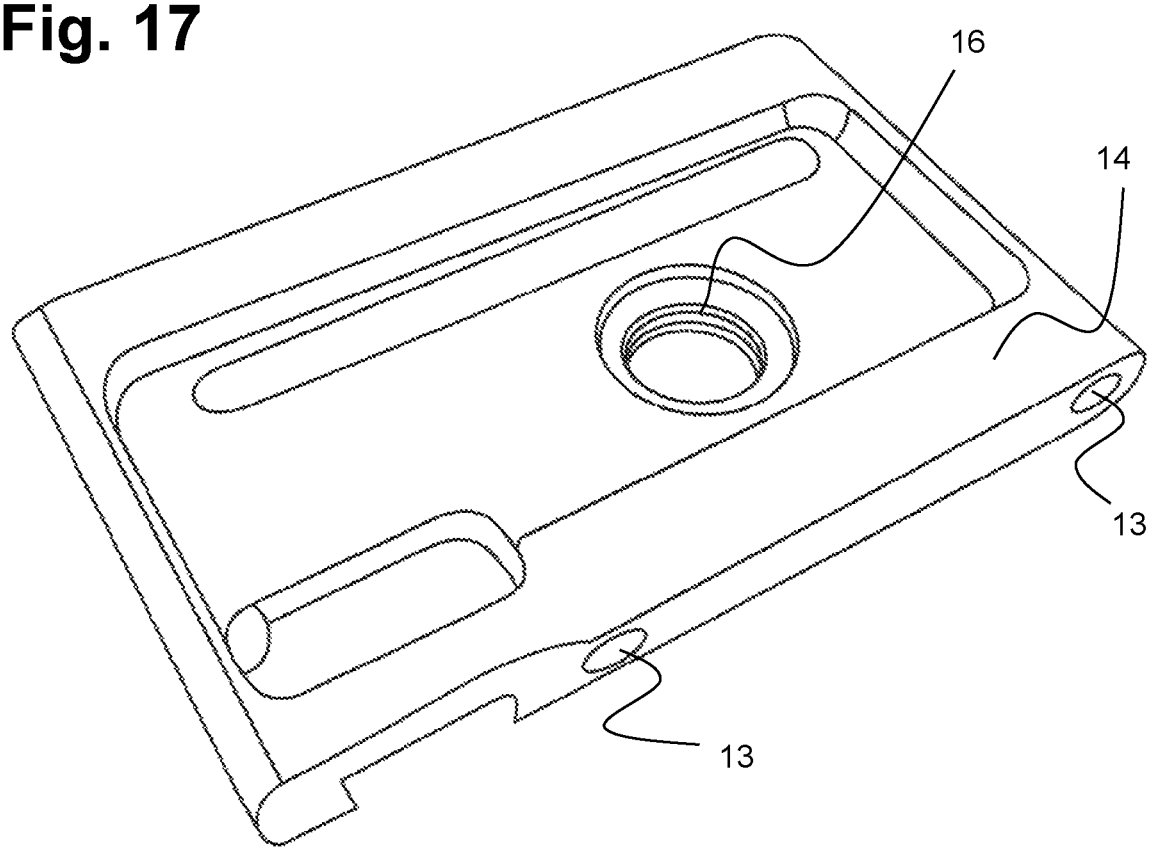
FIG. 17: The fixing plate as shown in FIG. 16, seen from the other side.
Figure 18:
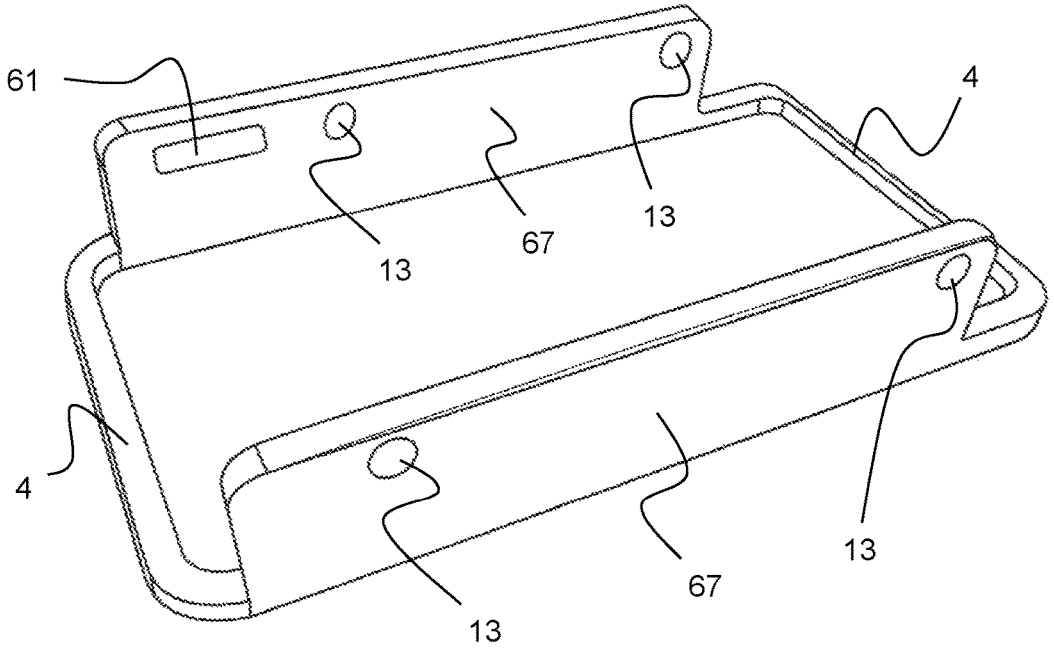
FIG. 18: An alternative version of the mounting frame.

FIG. 16 shows an alternative version of the fixing plate 14 with a central threaded hole 16. This fixing plate 14 has permanent magnets 13 mounted on its side. FIG. 17 shows this fixing plate 14 as shown in FIG. 16, seen from the other side, and FIG. 18 shows the mounting frame 4 belonging to this fixing plate 14 with its side walls 67 projecting upwards. The fixing plate 14 can be inserted between these side walls 67 and is then held securely in position by the magnetic forces of the permanent magnets 13 facing each other. The slot 61 on one side wall 67 of the mounting frame 4 is used to accommodate a plastic insert element which has the electrical contact points 5 to the guitar's output port. The electrical connections between the electrical outlets of the pickup on the fixing plate 14 and these contact points 5 on the side wall of the mounting frame 4 are made by means of pins 23, the heads of which project slightly beyond the edge of the fixing plate 14. When the fixing plate 14 is inserted, these pins 23 slide over the contact points 5 and establish the electrical connection. However, a pickup can be quickly removed from the mounting frame 4 with its fixing plate 14 at any time with sufficient force and without tools. It is grasped at the height adjuster 18 and simply pulled out of the mounting frame 4 and thus out of the recess 2.

Figure 19:
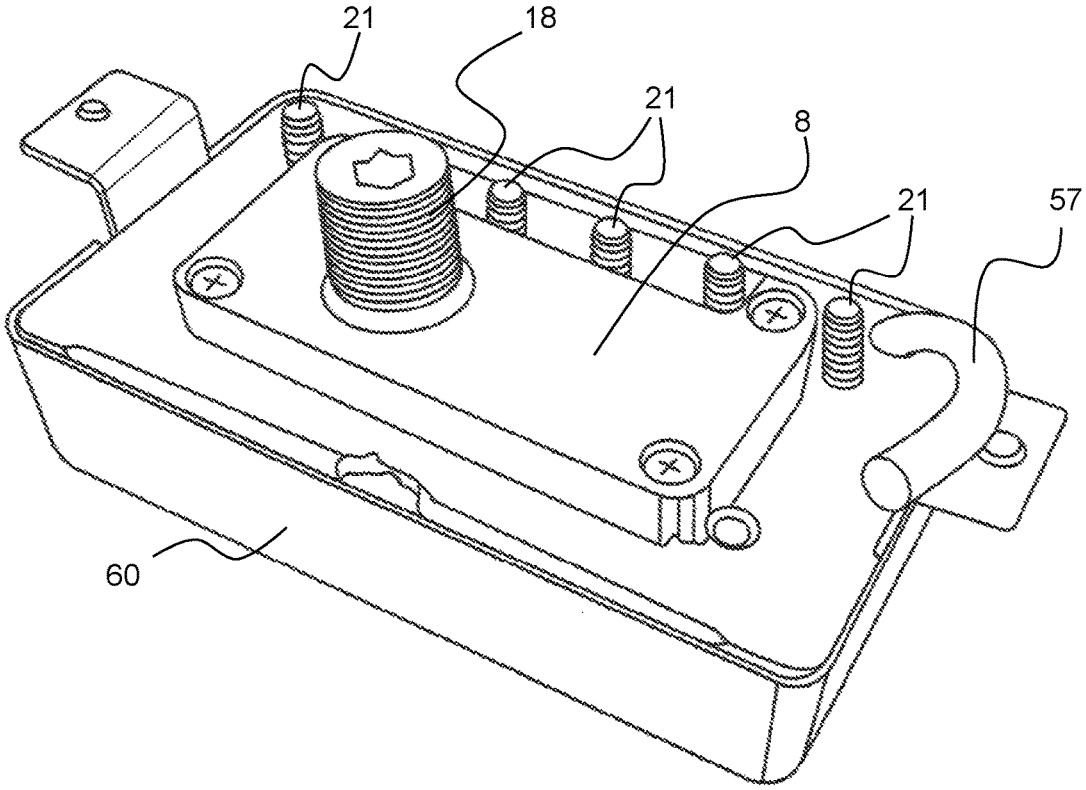
FIG. 19: The pickup with adjustment thread, seen from below, lying on the pickups.

FIG. 19 shows a pickup 1 with height adjuster 18 and its adjustment thread as seen from below, i.e. lying on the heads of its pickups 21 in a fallen position. On the underside of the pickup 1 you can see its base plate 8, while the coils, the bobbins and pickups are housed in a case 60. From the coils, their electrical outlets lead via cable 57 to the electrical contact points 10 on pins 23 on the fixing plate 14.

Figure 20:
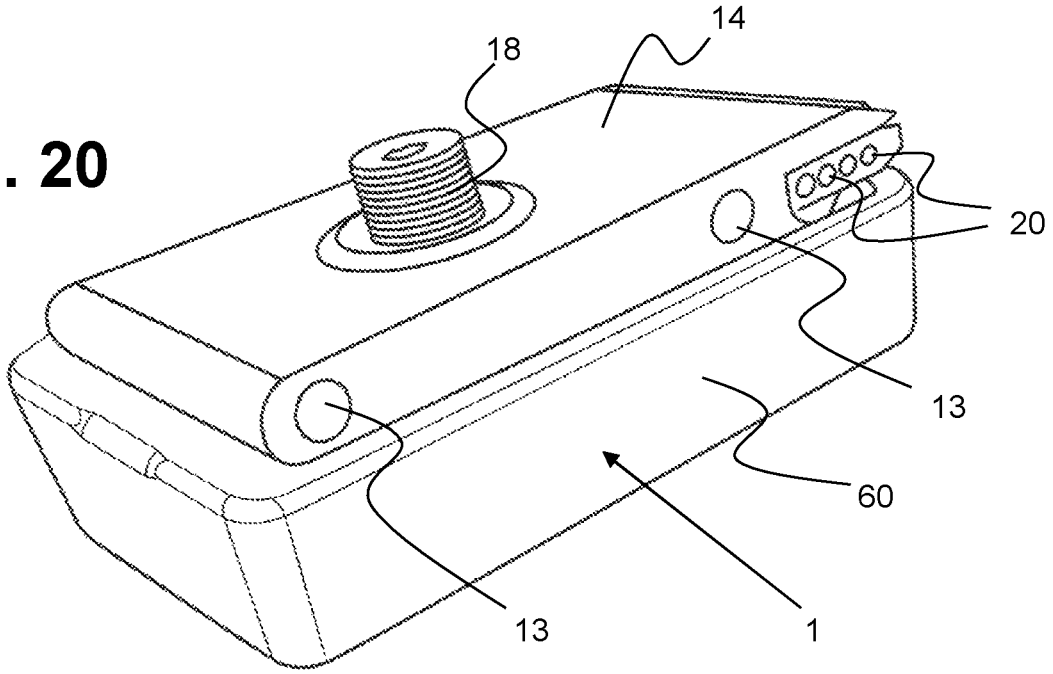
FIG. 20: The pickup lying on the pickups, with the fixing plate screwed onto the adjustment thread on its back.
Figure 21:
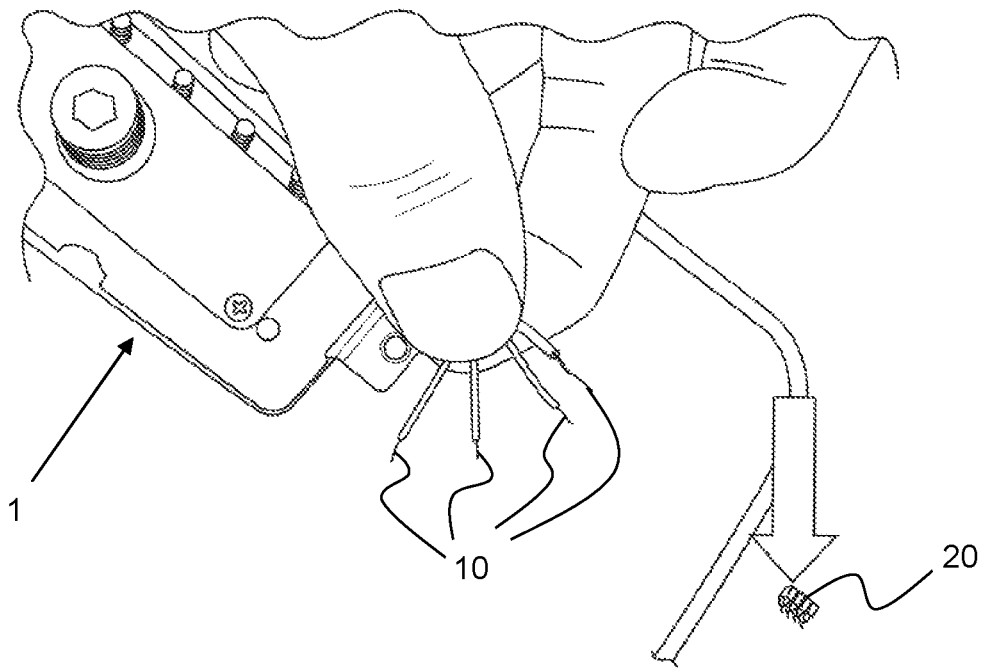
FIG. 21: The pickup with the four branching contact wires and next to them the four contact pins insulated against each other for making contact with the contact points on the pickup frame.

FIG. 20 shows the pick-up 1 and its housing 60 lying on the pickups in a tilted position, with the fixing plate 14 screwed onto the brass thread of the height adjuster 18 on its rear side, where you can see the permanent magnets 13 for holding on to the side walls 67 of the mounting frame 4 according to FIG. 18, and the pins 23 with rounded heads embedded in an insert element whose heads slightly protrude from the side wall of the fixing plate 14. FIG. 21 shows the four electrical outlets 10 from the coils of pickup 1, which are then connected to the insulated pins 23 in this insert element.

Figure 22:
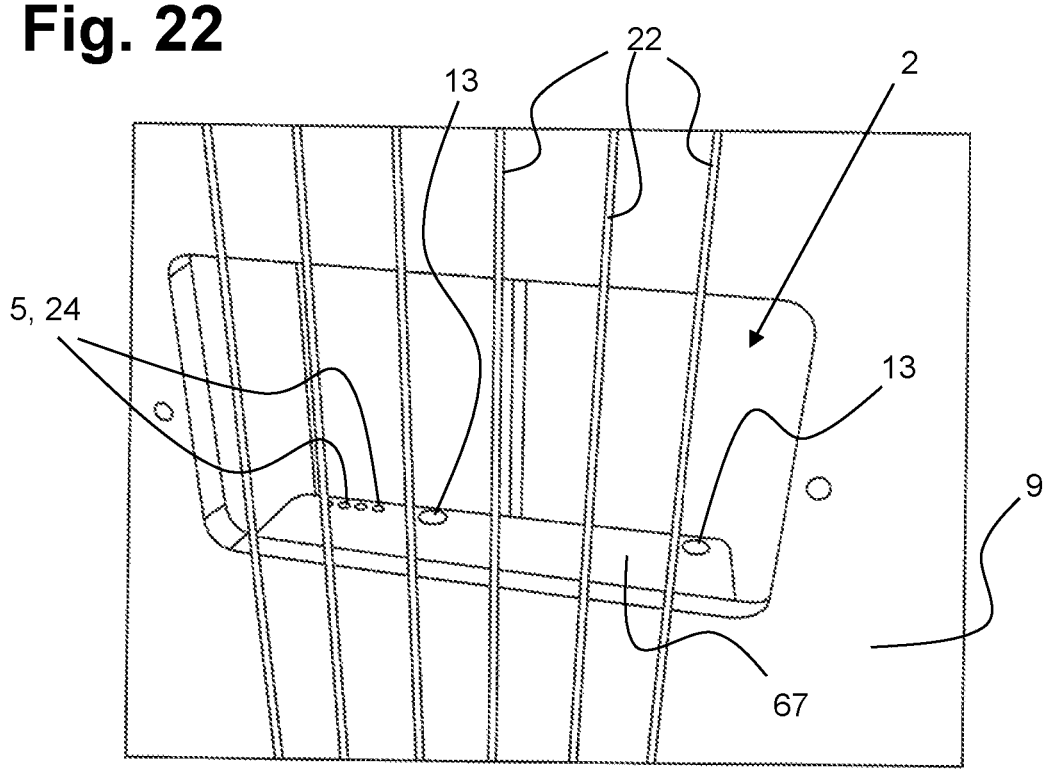
FIG. 22: A cut-out of the guitar body from above with the recess for a pickup, with the six strings running over it.
Figure 23:
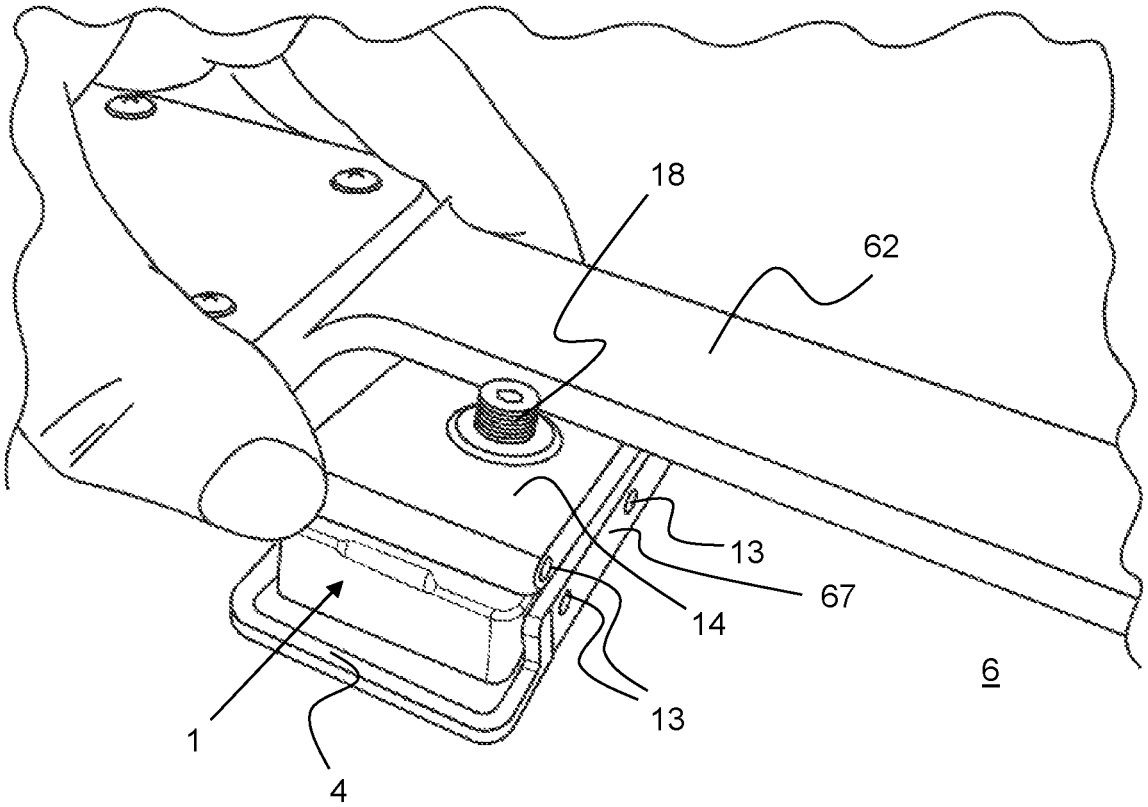
FIG. 23: A cut-out of the guitar body seen from the back when inserting the pickup.
Figure 24:
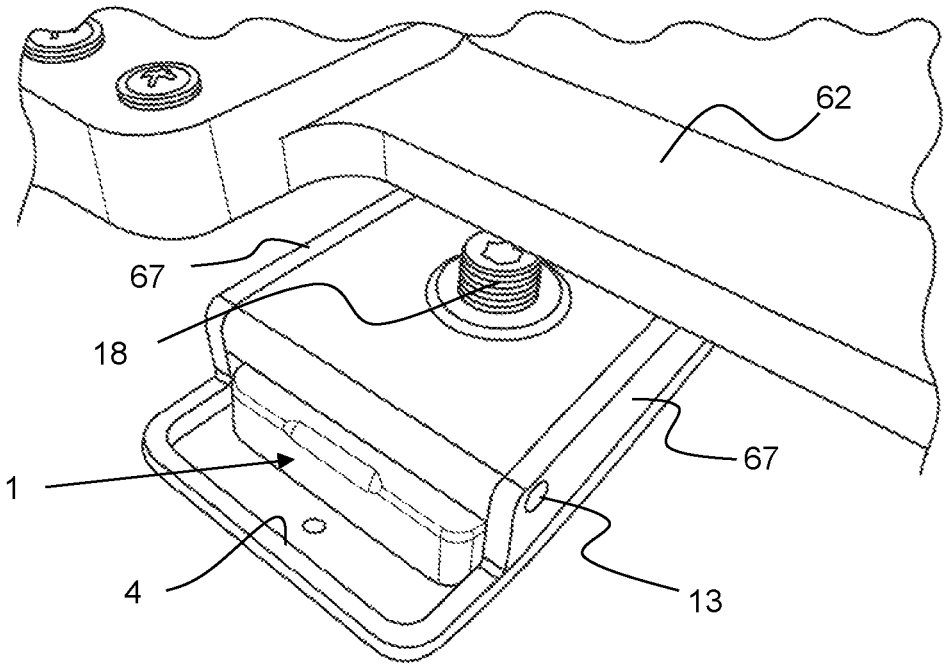
FIG. 24: The cut-out of the guitar body on its backside as shown in FIG. 23, with the pickup inserted.

FIG. 22 shows a cut-out of the guitar body 3, seen from its front side 9, with the recess 2 for a pickup, with the six strings 22 running over it. Only one side wall 67 with the electrical contact points 5 with dents 24, which lead to the output port on the guitar body 3 via a cable leading away, and the permanent magnets 13 in this side wall 67 can be seen from the mounting frame. FIG. 23 shows the same cut-out from the rear side 6 of the guitar body 3. Above this, an aluminum support 62 leads to the stability of the guitar, especially to the absorption of the string tension. The pickup element 1 is inserted here straight from the back 6 of the guitar body 3 by grasping it at the fixing plate 14 and inserting it between the two side walls 67 at the mounting frame 4. The permanent magnets 13 on the fixing plate 14 and on the side walls 67 will soon face each other and hold the fixing plate 14 in this position. FIG. 24 shows the situation when the pick-up element 1 is completely inserted and the permanent magnets 13 on the fixing plate 14 are opposite those on the side walls 67 of the mounting frame 2.

Instead of a magnetic mounting of the pickup element, the pickup element can also be designed in such a way that its fixing plate 14 in recess 2 clicks into a catch purely mechanically, for example against a mechanical spring force, and that this spring force can only be overcome by pulling out the fixing plate 14 with sufficient force, or that the catch can be released by pressing a button or actuating a slider or by turning a knob. The pickup element may also be held mechanically in the recess by being pushed into the recess against mechanical pressure springs from the rear of the guitar body and then a slider or turntable can be pushed or swung over the fixing plate at the rear, after which the pickup element or its fixing plate 14 is secured in its fitted position.

With such a pickup element, which can be inserted from the rear side 6 of the guitar body 3 in the recesses 2 in it in the manner shown, the replacement of pickup 1 for the production of different tones and tonalities is very simple and also very fast. The cover plate on the back leaves the recesses 2 with the inserted pickups carefully free. Practical tests have shown that it only takes 3 to 5 seconds to change a Pickup 1. In addition, the distance between the pickup and the strings 22 can be adjusted by turning the rubber wheel 55 on the height adjuster 18.

LIST OF NUMBERS

1 Pickup truck
2 Recess
3 Guitar bodies
4 Mounting frame
5 Contact points on the mounting frame or on the side brackets to the output port

6 Back of the guitar body
7 Output port on guitar body
8 Base plate on the pickup
9 Front of the guitar body
10 Electrical outlets on the pickup
11 Coil on pickup
12 Side holders on mounting frame
13 Permanent magnet
14 Fixing plate
15 Screws for mounting frame
16 Threaded bushing
17 Thread on the height adjuster of the pickup
18 Height adjuster
19 Locating hole Fixing plate
20 Guide pin on the base plate 8
21 Pickup
22 Strings
23 Spring loaded pins on the fixing plate.
24 Dent for the pins 23
25 Touch screen
26 On/Off button for bridge pickup
27 Mix button between bridge and neck pickup
28 On/Off button for neck pickup
29 Cams for passport seat
30 Solid body
31 Connection socket
32 Tone controls
33 Tone control
34 Pickup selector switch
35 Volume control
36 Vibrating lever
37 Orientation insert
38 Federation
39 Neck
40 Fingerboard
41 Collar
42 Tuning peg
43 Saddle
44 String suspension
45 Treble pickup
46 Mid-position pickup
47 Bass pickup
48 Strings
49 Rod magnet
50 Coilformers
51 Winding/coil
52 Bar magnet
53 Adjusting screw
54 Socket for adjusting screw
55 Rubber wheel for height adjustment
56 Bulge at the corners of the fixing plate
57 Cable from pickup coils to the pins on the fixing plate
58 Recess for the contacts
59 Hole for insert Output port
60 Pickup housing
61 Slot for insert element with electrical contacts
62 Steel support for absorption of string tension
63 Recess for electronic circuit
64 Electronic switching
65 Batteries for electronic circuits
66 Recess to accommodate the touch screen
67 side panels on mounting frame 4
68 Pressure springs
69 Rubber Wheels an guitar body

The invention claimed is:

1. An electric guitar comprising:

at least one pickup in a continuous recess on a guitar body, wherein the at least one pickup operable to be inserted into the continuous recess from a rear of the guitar body without use of tools and operable to close electrical contacts between coils and terminals in a housing located within the continuous recess, which lead via a cable to an output port on the guitar body, and in that the pickup can be inserted into and removed from a fitting seat without tools and is held in the fitting seat by at least one permanent magnet, or is held by a mechanical, spring-loaded latching device, or is held by a mechanical slider which can be pushed partially over the recess, or by a turntable which can be pivoted partially over the recess;

wherein the pickup can be installed in a receiving frame which is arranged in the recess and which has electrical contact points which lead via a cable to the output port on the guitar body;

wherein the pickup has a base plate on its rear side and a fixing plate, thereon, which can be inserted into the receiving frame with an exact fit and is magnetically held therein;

wherein a distance between the base plate and the fixing plate is finely adjustable when the pickup is installed; and wherein, when the pickup is in the inserted state, electrical outlets of each of a plurality of coils each close an electrical contact with the contact points on the receiving frame via spring-loaded pins on the fixing plate.

2. The electric guitar according to claim 1, wherein the receiving frame forms a side holder on each of two opposite sides, and these side holders form the fitting seat for the fixing plate and are equipped with permanent magnets for holding the inserted fixing plate, and wherein one side holder is provided with electrical contact points which are connected via a cable to the output port on the guitar body, and the electrical outlets of each of the coils of the pickup lead to spring-loaded pins on the fixing plate and these pins each close an electrical contact with the contact points on the side holder of the receiving frame.

3. The electric guitar according to claim 1, wherein on the receiving frame on two opposite sides each includes a side holder screwed on with two screws, so that in each case two of the screws pass through the side holder in their end region, and that these side holders form a mechanical fitting seat for the fixing plate, and each side holder is equipped with two permanent magnets, for holding the inserted fixing plate, and that one of the two side holders is provided with electrical contact points which are connected via a cable to the output port on the guitar body, and the electrical outlets of each of the coils of the pickup lead to spring-loaded pins on the fixing plate and these pins, when the pickup is inserted, each close an electrical contact with the contact points on the side holder of the receiving frame.

4. The electric guitar according to claim 1, wherein the base plate is connected to the base plate of the pickup at a variable distance from the latter by the fixing plate having a threaded bush by means of which it can be screwed over a thread of a height adjuster of the pickup, and further in that the fixing plate has a receiving hole for a guide pin which is attached to the base plate in a vertically projecting manner, so that when the height adjuster is rotated on a free side of the fixing plate, the distance between the fixing plate and the base plate and thus the pickup can be finely adjusted and thus the distance of the pickup from the strings of the electric guitar can be varied.

5. The electric guitar according to claim 1, wherein the electrical outlets of the coils of the pickup close an electrical contact with the contact points on the receiving frame via the fixing plate, in that four spring-loaded pins are arranged on the fixing plate and project away from it at right angles, which, when the fixing plate is placed on the receiving frame or side holders, fit into contact points matching them, these contact points each forming a dent for receiving the pins.

6. The electric guitar according to claim 1, wherein the receiving frame is designed as a single injection-moulded part made of plastic, and the fixing plate to be placed thereon is also a plastic injection-moulded part which fits exactly into the receiving frame, fits precisely into the receiving frame between end cams and is held in this fit by permanent magnets.

7. The electric guitar according to claim 1, wherein the guitar body has two or three recesses for inserting pickups, and a touch screen is arranged on the front side of the guitar body, and in that an electronic circuit is present in or on the guitar body, so that by moving a finger on the touch screen the individual pickups if present a middle position pickup and a neck pickup, can be switched on or off continuously.

8. The electric guitar according to claim 1, wherein the guitar body has two or three recesses for the insertion of pickups, and a touch screen is arranged on the front of the guitar body, and that an electronic circuit is present in or on the guitar body, so that by simultaneously touching the touch screen in a front area and in a middle, a neck pickup immediately switches on and a bridge pickup simultaneously switches off, and when touched again in this constellation, the bridge pickup switches on again, and vice versa by simultaneously touching the touch screen in the middle and in the rear area, the bridge pickup is switched on immediately and the neck pickup is switched off at the same time, and when touched again in this constellation, the neck pickup is switched on again.

9. A pickup element for an electric guitar comprising:

a fixing plate with a threaded bush for a height adjuster of the pickup and a receiving hole for a guide pin on a base plate of the pickup, wherein the fixing plate is manually insertable without tools on an associated receiving frame, which is intended for installation in a continuous pickup recess on a guitar body from the rear side thereof, and the receiving frame forms a fitting seat for this fixing plate, and is releasable from this receiving frame again without tools;

wherein the fixing plate has spring-loaded pins which are electrically connected to coils of the pickup, and the pickup further includes the receiving frame with side holders screwed onto this receiving frame, which are each equipped with two permanent magnets, and in that the pickup with the fixing plate can be inserted by hand into the fitting seat without tools and is magnetically held therein, and in so doing its spring-loaded pins close electrical contact with contact points on the side holder, and in that the fixing plate with the pickup can again be released from the fitting seat without tools.

10. The pickup element according to claim 9, further comprising two side holders screwed onto the receiving frame with pressure springs supported on the receiving frame, so that by adjusting screws the position of the side holders relative to the receiving frame can be adjusted and thus an inclination of an inserted pickup and thus the distances of the pickups to various strings can be adjusted.

* * * * *